US006380476B1

(12) United States Patent
Heijnen et al.

(10) Patent No.: US 6,380,476 B1
(45) Date of Patent: Apr. 30, 2002

(54) GENERATING ELECTRIC POWER IN A WELLBORE

(75) Inventors: Wilhelmus Hubertus Paulus Maria Heijnen, Nienhagen (DE); John Foreman Stewart; Robert Nicholas Worrall, both of Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/724,480

(22) Filed: Nov. 28, 2000

(30) Foreign Application Priority Data

Nov. 29, 1999 (EP) ..... 99204030

(51) Int. Cl.[7] ..... H01L 35/28
(52) U.S. Cl. ..... 136/208; 136/242; 166/65.1
(58) Field of Search ..... 136/208, 209, 136/211, 212, 242; 166/65.1

(56) References Cited

U.S. PATENT DOCUMENTS 5,929,372 A 7/1999 Oudoire et al.
5,939,667 A 8/1999 Oudoire et al.

FOREIGN PATENT DOCUMENTS

GB 2336943 A 3/1999
WO WO 01/40619 * 6/2001

OTHER PUBLICATIONS

International Search Report of Mar. 7, 2001.

* cited by examiner

*Primary Examiner*—Bruce F. Bell
*Assistant Examiner*—Thomas H. Parsons

(57) ABSTRACT

A device for generating electric power in a wellbore formed in an earth formation, the wellbore being provided with a conduit for passage of a stream of hydrocarbon fluid produced from the earth formation, the power generator comprising a mandrel adapted to be incorporated in the conduit, the mandrel being provided with a side pocket arranged to receive a thermoelectric power generator having a first wall in thermal contact with the stream of hydrocarbon fluid and a second wall in thermal contact with the earth formation surrounding the wellbore.

7 Claims, 1 Drawing Sheet

GENERATING ELECTRIC POWER IN A WELLBORE

BACKGROUND OF THE INVENTION

Field of the Invention

The present invention relates to a device for generating electric power in a wellbore formed in an earth formation, the wellbore being provided with a conduit for passage of a stream of hydrocarbon fluid produced from the earth formation.

SUMMARY OF THE INVENTION

Downhole electric power generating devices for electronic data communication or for signal transmission, have been applied in the form of downhole turbines drive by the stream of hydrocarbon fluid. However such devices have certain drawbacks and are prone to failure.

It is an object of the invention to provide an improved device for generating electric power in a wellbore formed in an earth formation.

In accordance with the invention there is provided a device for generating electric power in a wellbore formed in an earth formation, the wellbore being provided with a conduit for passage of a stream of hydrocarbon fluid produced from the earth formation, the power generator comprising a mandrel adapted to be incorporated in the conduit, the mandrel being provided with a side pocket arranged to receive a thermoelectric power generator having a first wall in thermal contact with the stream of hydrocarbon fluid and a second wall in thermal contact with the earth formation surrounding the wellbore.

The stream of hydrocarbon fluid is significantly hotter than the earth formation surrounding the wellbore, so that a temperature difference is created between the two junctions of the thermocouple which thereby generates an electric current. The current can be used to charge a rechargeable downhole battery.

BRIEF DESCRIPTION OF THE DRAWINGS

The invention will be described further in more detail and by way of example with reference to the accompanying drawings in which FIG. 1 schematically shows a first embodiment of the device according to the invention.

DETAILED DESCRIPTION OF THE DRAWINGS

Figure 1:
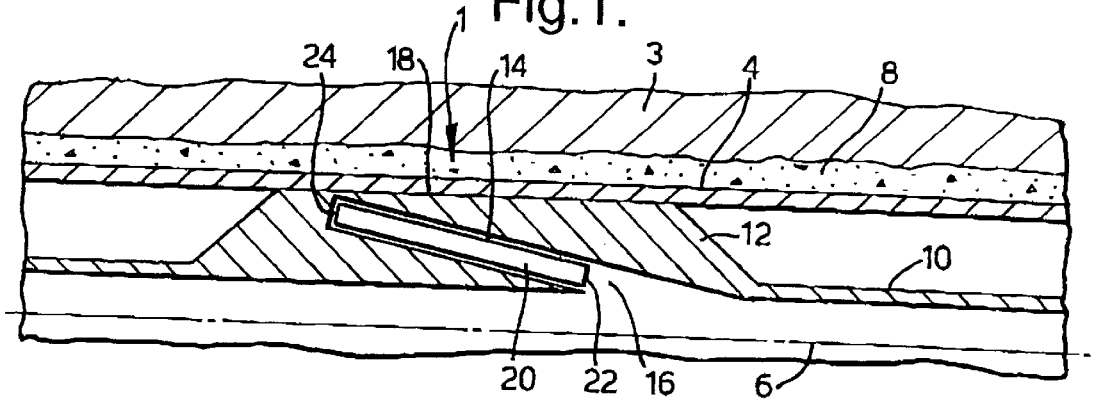

Referring to FIG. 1 there is shown a wellbore 1 formed in an earth formation 3, the wellbore 1 being provided with a tubular casing 4 having longitudinal axis of symmetry 6. The casing 4 is fixed in the wellbore 1 by a layer of cement 8. A production tubing 10 for passage of a stream of hydrocarbon fluid produced from the earth formation, extends concentrically through the casing 4. The production tubing 10 incorporates a mandrel 12 provided with a side pocket 14 having an open end 16 at the inner surface of the production tubing 10 and having a radially outer surface 18 in thermal contact with the inner surface of the casing 4. A thermoelectric power generator 20 is arranged in the side pocket 14, the thermoelectric power generator 20 having a first wall 22 in thermal contact with the interior of the production tubing 10 and a second wall 24 in thermal contact with the radially outer surface 18 of the side pocket 14.

Figure 2:
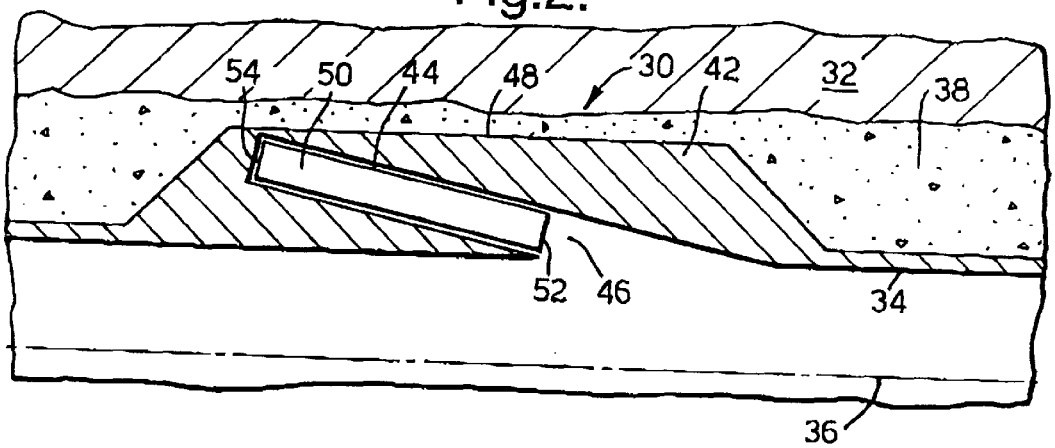
FIG. 2 schematically shows a second embodiment of the device according to the invention.

In FIG. 2 is shown a wellbore 30 formed in an earth formation 32, the wellbore being provided with a tubular casing 34 having longitudinal axis of symmetry 36. The casing 34 is fixed in the wellbore 30 by a layer of cement 38. The casing 34 is arranged for passage of a stream of hydrocarbon fluid produced from the earth formation 32, and incorporates a mandrel 42 provided with a side pocket 44 having an open end 46 at the inner surface of the casing 34 and having a radially outer surface 48 in contact with the layer of cement 38. The thermoelectric power generator 50 described with reference to thermoelectric power generator 20 shown on FIG. 1 is now arranged in the side pocket 44, whereby the first wall 52 of the power generator 20 is in thermal contact with the interior of the casing 34 and the second wall 54 is in thermal contact with the radially outer surface 48 of the side pocket 44.

Figure 3:
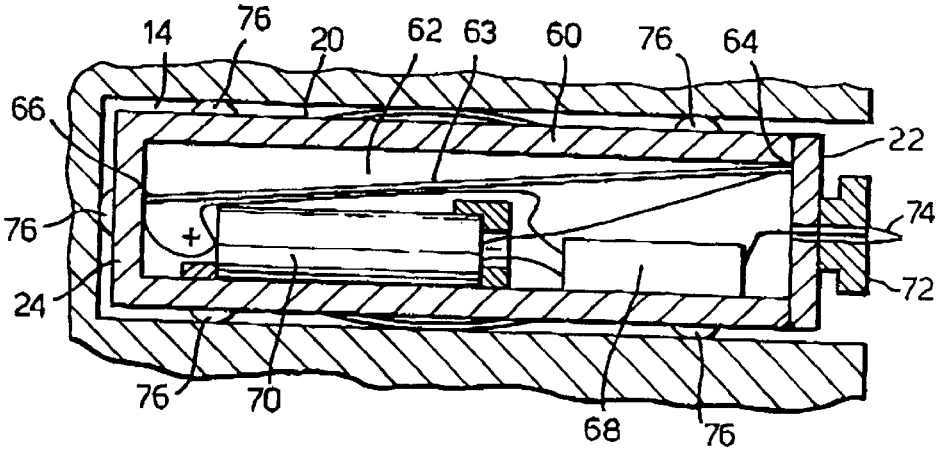
FIG. 3 schematically shows an embodiment of a thermoelectric generator for use in the first and second embodiments.

In FIG. 3 is shown in more detail the electric power generator 20 when arranged in the side pocket 14 of the first embodiment. The power generator 20 includes a housing 60 having a chamber 62 provided with a thermocouple 63 having a hot junction 64 in thermal contact with the first wall 22 and a cold junction 66 in thermal contact with the second wall 24. The respective junctions 64, 66 are incorporated in an electronic circuit including control module 68 and rechargeable battery 70. The control module 68 is arranged to electronically communicate with a surface facility (not shown) and a remote wellbore device (not shown). The housing 60 is provided with a running neck 72 provided with a jack 74 for communication with the electronic circuit. The jack can alternatively be replaced by an inductive coupling (not shown). A plurality of buttons 76 provide some spacing between the housing and the inner surface of the side pocket 14.

During normal operation of the first embodiment, a stream of hot hydrocarbon fluid flows from a producing zone (not shown) of the earth formation into a lower part of the wellbore 1 and from there through the production tubing 10 to surface. The stream thereby passes along the first wall 22 of the thermoelectric power generator 20 and thereby transmits heat to the first wall 22. The heat is further transmitted to the hot junction 64 of the thermocouple 63, which hot junction thereby substantially assumes the temperature of the hot stream. The cold junction 66 of the thermocouple 63 is in thermal contact with the earth formation 3 via the layer of cement 8, the casing 4 and the wall of the mandrel 12. The cold junction thereby substantially assumes the temperature of the earth formation 3, so that the temperature of the cold junction 66 is lower than the temperature of the hot junction 64. As a result an electric current generated by the thermocouple flows through the electronic circuit thereby charging the battery 70.

The battery provides electric power to the control module 68 when it is desired to transmit electric signals to the surface facility or the remote wellbore device, or to receive electric signals from the surface facility or from the remote wellbore device.

Normal operation of the second embodiment is similar to normal operation of the first embodiment, except that in the second embodiment the stream of hot hydrocarbon fluid flows through the casing 34 instead of through the production tubing 10.

What is claimed is:

1. A device for generating electric power in a wellbore formed in an earth formation, the wellbore being provided with a conduit for passage of a stream of hydrocarbon fluid produced from the earth formation, the power generator comprising a mandrel adapted to be incorporated in the conduit, the mandrel being provided with a side pocket arranged to receive a thermoelectric power generator having a first wall in thermal contact with the stream of hydrocarbon fluid and a second wall in thermal contact with the earth formation surrounding the wellbore.

2. The device of claim 1, wherein thermoelectric generator includes at least one thermocouple, each thermocouple having a hot junction in thermal contact with the first wall and a cold junction in thermal contact with the second wall.

3. The device of claim 2, wherein the thermoelectric power generator includes a rechargeable battery arranged to be charged by the thermocouple.

4. The device of claim 3, wherein the battery is incorporated in an electronic control circuit for transmitting signals to at least one of a surface facility and a remote wellbore device.

5. The device of claim 4, wherein the electronic control circuit is adapted to receive control signals from surface.

6. The device of claim 5, wherein the wellbore is provided with a tubular casing and the conduit is formed by a production tubing extending through the casing, and wherein the side pocket has a radially outer surface in thermal contact with the inner surface of the casing.

7. The device of claim 6, wherein the conduit is formed by a tubular casing extending through the wellbore, and wherein the side pocket has a radially outer surface in thermal contact with a layer of cement surrounding the casing.

* * * * *